United States Patent [19]

McLaughlin

[11] 4,407,099

[45] Oct. 4, 1983

[54] WINDOW

[75] Inventor: James A. McLaughlin, Dover, Mass.

[73] Assignee: Titanseal Corporation, Dedham, Mass.

[21] Appl. No.: 246,572

[22] Filed: Mar. 23, 1981

[51] Int. Cl.[3] ..... E06B 3/28

[52] U.S. Cl. ..... 52/202; 52/397; 49/478

[58] Field of Search ..... 52/202, 203, 397, 400, 52/788, 823; 49/478, 488, 501

[56] References Cited

U.S. PATENT DOCUMENTS

| | | | |
|---|---|---|---|
| 3,158,909 | 12/1964 | Downs | 52/202 X |
| 3,158,909 | 12/1964 | Downs | 52/202 |
| 4,110,942 | 9/1978 | Scocomb, Jr. | 52/397 X |
| 4,110,942 | 9/1978 | Slocomb | 52/397 |
| 4,151,696 | 5/1979 | Knights et al. | 52/397 X |
| 4,151,696 | 5/1979 | Knights-n-Wilson | 52/397 |
| 4,215,517 | 8/1980 | Everson | 52/202 |

FOREIGN PATENT DOCUMENTS

| | | | |
|---|---|---|---|
| 1042723 | 11/1978 | Canada | 52/202 |

*Primary Examiner*—John E. Murtagh
*Assistant Examiner*—Richard E. Chilcot, Jr.
*Attorney, Agent, or Firm*—Andrew F. Kehoe

[57] ABSTRACT

A novel framing system for light-weight windows is disclosed. The frame is versatile because it is constructed to snugly receive window panes having substantially different thicknesses. In some such frames rigidity is imparted to the frame by adding a flange member which is utilized as a handle means.

2 Claims, 2 Drawing Figures

WINDOW

BACKGROUND OF THE INVENTION

This invention relates to a novel construction of a light-weight window of the type formed of an extruded plastic frame and having a transparent organic polymer pane. The invention particularly relates to a versatile framing construction.

In recent years, a number of light-weight window structures have been introduced. Prominent among these are light-weight structures formed of a transparent plastic pane and set into extruded plastic frame members which normally carry a channel for receiving the pane member. Typically, a frame member will be utilized on each of the four sides of the frame. In the usual case, the framing members will be formed to receive, for example, weather stripping and/or fastening means. The fastening means can be fiber-loop-locking strips such as those well known to the art and available under the trademark Velcro. Pressure sensitive adhesive-bearing attachments may also be used, most popular are magnetic strips. In each case, the fastening means is adapted to seal against a window molding on which a complimentary strip of, say, the magnetic strip or Velcro, may be fastened. One important use of such light-weight windows is in the economical construction of easily-handled storm windows which can be readily mounted, and readily removed, by elderly persons.

When manufacture of such windows takes place under the control of a single manufacturing facility, it is a relatively simple matter to assemble a closely-specified pane sheeting into a molding having a channel precisely manufactured to receive it. The same result is achieved when a supplier ships these moldings and the carefully-specified panes to a customer for assembly away from the supplier's place of business.

In commercial practice, however, it is cumbersome to tie the sale and shipment of generally-available pane material to the sale and shipment of the molding material. Numerous window-constructing facilities around the country can more efficiently control their inventory and transportation charges by buying readily available sheet material directly from its suppliers, sizing it themselves for a particular window size. Most flexibility is achieved because the customer has a point-of-sale capability to specify the break-resistance polycarbonate windows or the more conventional polyacrylate windows.

However, each small window maker must undertake the job of quality control with respect to the gauge of pane material which is received and match it to the capabilities of different frame stock.

As will be described below, Applicants' invention is directed towards providing an improved framing structure directed, in large part, to the solution of this problem.

SUMMARY OF THE INVENTION

It is a principal object of the invention to provide a framing strip which is of sufficient resiliency to accommodate, yet hold snugly, window panes of substantially varying thicknesses.

A further object of the invention is to provide a framing strip which comprises a handle member to facilitate handling of the windows without any tendency to loosen the snug relationship between pane and framing strip.

Other objects of the invention will be obvious to those skilled in the art on their reading of this disclosure.

The above objects have been constructed by making relatively simple but functionally critical changes in prior art framing structures. More particularly, a unitary, extruded, framing member has been constructed wherein a generally U-shaped channel which accommodates the window pane is formed with one relatively resilient wall member which is normally slanted, bottom to top, towards an opposite and stiffer wall of the U-shaped channel. The resilience is sufficient that a manufacturer can readily insert panes having a relatively wide range of thicknesses and still have the resilient wall provide a snug fit against the window. The resilient wall is directed inwardly towards the opposite wall of the narrow/deep channel, so that the ratio of the top opening width to bottom of the U is three to 1 or more. Another unforeseen advantage of the structure of the invention is the ability to receive, more easily, replacement panes as the plastic strips stiffen somewhat over their lifetime.

The resilient wall member does not function to strengthen a wider and shallower channel of the structure, but the relatively rigid wall of the deeper channel does so function. In general, it is desirable to maintain this relative rigidity to avoid stressing and loosening weatherstripping and fastening means carried in the wider channel.

In preferred embodiments of the invention, the pane-receiving channel is conveniently utilized with pane thicknesses of from about 0.08 to 0.1 inch (as in lighter-weight windows) and from about 0.09 to 0.13 inch (as in somewhat heavier window construction).

Although the relatively rigid wall of the pane-receiving channel is not of such great resilience that it materially aids in window manufacture, it is of sufficient resiliency so that when a flange-like handle means extending away from the channel is incorporated therein, the handle acts as a lever to push the rigid wall even more tightly against the window when it is lifted. The effect is primarily one of imparting a relatively secure reinforcement to the flange from the force exerted by the window.

Illustrative Example of the Invention

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

IN THE DRAWINGS

Figure 1:
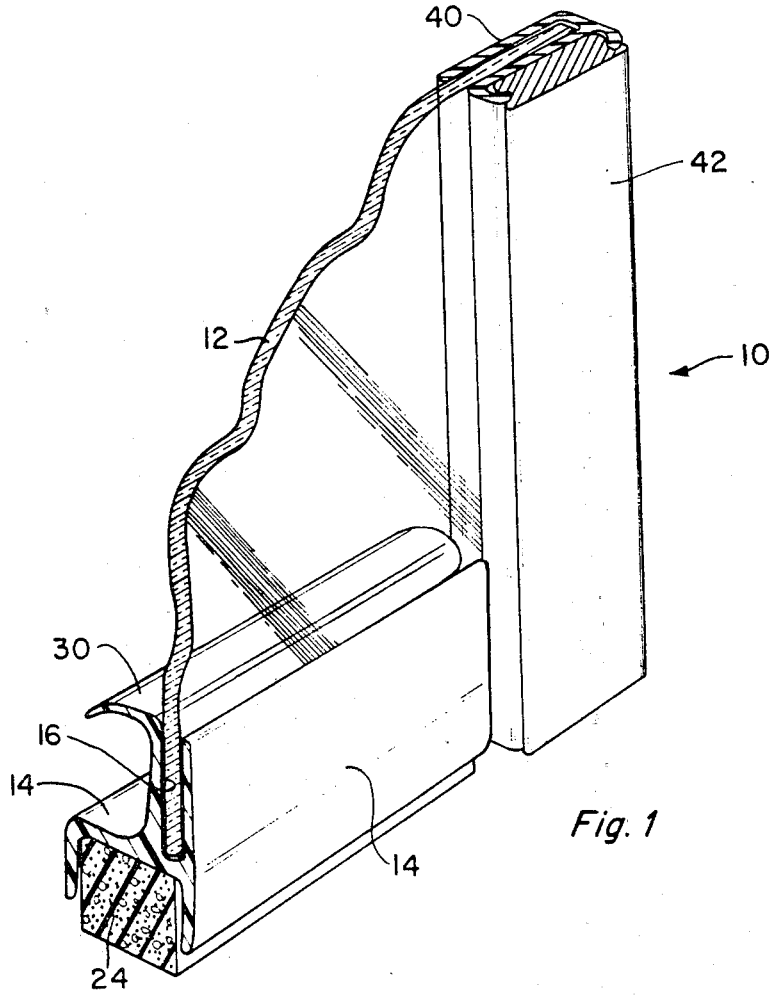
FIG. 1 is fragmentary of a window of the invention.
Figure 2:
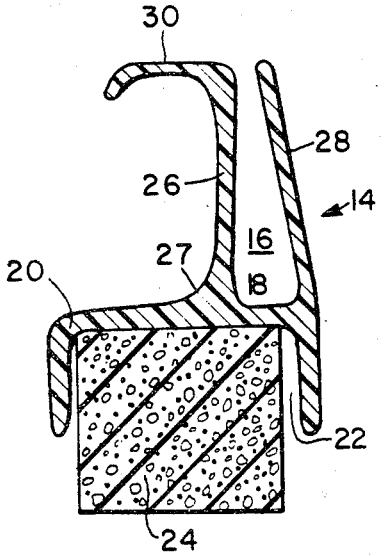
FIG. 2 illustrates a crossection of one framing member constructed according to the invention.

Referring to FIGS. 1 and 2, it is seen that a window 10 is formed of a transparent pane 12 formed of acrylic resin of the type sold under the trademark PLEXIGLASS by Rohm & Haas Co. The bottom edge portion of pane 12 is snugly positioned in a framing strip 14.

Strip 14 has been formed of a continuously extruded thermoplastic composition and cut to the appropriate length for fabrication of the window.

Strip 14 comprises a relatively narrow and deep channel 16 which is adapted to receive the pane. Channel 16 is U-shaped with the bottom wall portion 18 of the U-forming being common to with a portion of wall member 20 which forms the "bottom" of an inverted U-shaped channel relatively wide and shallow channel 22 which serves to hold weatherstripping 24. The structure of channel 22 is reinforced, or made more rigid, by wall 26 which extends upwardly to form a leg of channel 16. This effect is aided by the relatively wide base structure 27 at the bottom of wall 26, upwardly from wall 20 to form one leg of channel 16.

The other leg of channel 16 is a relatively resilient member which does not substantially reinforce the channel 22 structure. However, member 28 is readily flexed ourwardly to receive a storm window and thereupon forms a biased, or spring-like, clip action against the window.

It will be noted that resilient wall 28 slants inwardly towards wall 26. It will readily accommodate a pane 12 which will cause it to become vertical.

Wall 26 carries a flange which serves as a handle in lifting or unsealing the windows of the invention. Flange 30 extends far enough from wall 26 that, when an upward lifting force is applied to it, there is a tendency to tighten the grip of the structure on the window pane. The utility of this feature of the invention is not so much to grip the pane but to have the pane resist excessive movement of the handle despite its somewhat flexible nature.

Figure 3:
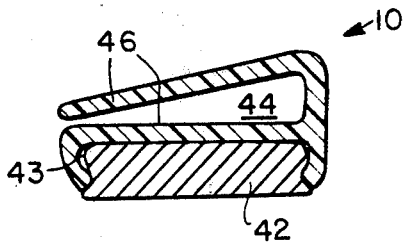
FIG. 3 illustrates a crossection of another framing member constructed according to the invention and convenient for use as the bottom frame member in window construction.

Referring to FIGS. 1 and 3, it is seen that a framing strip 10 is used along the sides of the window. (Such a strip is commonly used along the tops of the windows also, but need not be shown to illustrate the novel features of the invention because the top strip and its use will be readily apparent from a description of the bottom strip.)

A fastening means 42, in this case a magnetic strip, is held within the wide and shallow channel 43. The pane 12 will fit into the narrow and deep channel 44. As in the structure of framing strip 14, the deep channel is U-shaped with a resilient polymeric wall 46 adapted to open to receive a pane and, then, form a biasing means to hold the pane snugly during handling, temperature cycles and other stresses encountered during use.

Again, the resilient wall 46 is so positioned that there is substantially no reinforcing between it and the structure of channel 44. A major part of the structure of the relatively stiff-walled channel 42 is made up of wall 46 which is common to channels 43 and 44.

In general, the strips shown in the drawings are those used in residential markets and are drawn to about three times the linear scale of one of the more successfully-marketed products.

The resilient walls of the invention may be pulled into vertical position by a force of less than six lbs., preferably less than three lbs., applied with a steel wire, e.g. a paper clip, at the position being pulled to vertical.

The framing strip composition can be formed of many thermoplastic polymers. Normally, they will be filled with a suitable amount of pigment or filler appropriate for a particular polymer. Polymer compositions based on vinyl chloride polymers or copolymers are suitable as are polypropylene polymer systems and acrylonitrile-butadiene-styrene systems. The composition should also contain the normal stabilizers and antioxidants which are usually used in thermoplastic compositions to be used over a period of years.

The resilient or flexible nature of the framing strip of the invention have the additional advantage of making them particularly valuable for manufacturing ancillary products. For example, the resilient nature of the strips aids in the insertion of fabric which can be inserted and will be held snugly within the deep channel. The channel itself provides a suitable zone for adding, in liquid form, an adhesive or a plastic anchoring composition means which, on solidifying, forms an anchor means. These strips then serve as a lower framing means or handle means on curtains and the like.

It is also to be understood that the following claims are intended to cover all of the generic and specific features of the invention herein described and all statements of the scope of the invention which might be said to fall therebetween.

What is claimed is:

1. An extruded plastic unitary window framing strip of the type formed of extruded wall segments of about the same thicknesses and comprising a U-shaped channel therein forming means to receive the bottom edge portion of a window pane wherein said U-shaped channel is formed of (a) a first long wall which is relatively resilient and normally slants, from bottom to top, towards (b) a second long wall such that the distance separating said walls at the bottom thereof is about three times the width of the distance normally separating said long walls at the top thereof; said framing strip also comprising of second and lower channel opening the opposite direction from said U-shaped channel, a top end segment of which comprises in part a bottom wall of said U-shaped channel; said second long wall rising out of said top segment and forming a reinforcing member for said top segment at an intermediate position about halfway between side walls of said lower channel and thereby forming means to rigidify said top segment of said lower channel, and wherein said second long wall bears a handle extending in a direction away from said first long wall, and wherein said second long wall comprises a relatively wide base structure at the bottom thereof, and wherein said handle, on being used to lift said window, forms means to act as a lever to tighten said rigid wall against said window.

2. A window frame strip as defined in claim 6 wherein said first long wall is readily deflected to a vertical position near an edge of said wall by less than a six-pound pulling force.

* * * * *

UNITED STATES PATENT AND TRADEMARK OFFICE

CERTIFICATE OF CORRECTION

PATENT NO. : 4,407,099

DATED : October 4, 1983

INVENTOR(S) : James A. McLaughlin

It is certified that error appears in the above-identified patent and that said Letters Patent are hereby corrected as shown below:

Column 4, line 60 change "6" to "1"

Signed and Sealed this

Third Day of January 1984

[SEAL]

*Attest:*

GERALD J. MOSSINGHOFF

*Attesting Officer*

*Commissioner of Patents and Trademarks*